United States Patent [19]

Chakravarti

[11] 4,348,517

[45] Sep. 7, 1982

[54] PROCESS AND FINISH COMPOSITION FOR PRODUCING ADHESIVE ACTIVE POLYESTER YARN

[75] Inventor: Kalidas Chakravarti, Richmond, Va.

[73] Assignee: Allied Chemical Corporation, Morris Township, Morris County, N.J.

[21] Appl. No.: 214,554

[22] Filed: Dec. 9, 1980

[51] Int. Cl.[3] ..... B05D 1/24; B05D 1/38; B05D 3/12; D06M 13/18

[52] U.S. Cl. ..... 523/425; 8/115.6; 8/DIG. 4; 156/110 A; 252/8.9; 427/387; 427/389.9; 428/391; 428/395; 523/456

[58] Field of Search ..... 260/29.2 M, 29.1 SB; 8/115.6, DIG. 4; 252/8.9; 156/110 A; 523/425, 456; 427/387, 389.9; 428/391, 395

[56] References Cited

U.S. PATENT DOCUMENTS

| | | | |
|---|---|---|---|
| 3,542,639 | 11/1970 | Manino | 156/110 A |
| 3,642,518 | 2/1972 | Miki et al. | 427/389.9 |
| 3,672,977 | 6/1972 | Dardoufas | 428/395 |
| 3,730,892 | 5/1973 | Marshall et al. | 428/396 |
| 3,793,425 | 2/1974 | Arrowsmith | 427/175 |
| 3,968,304 | 7/1976 | Wise | 156/110 A |
| 4,044,189 | 8/1977 | Arrowsmith | 428/295 |
| 4,054,634 | 10/1977 | Marshall et al. | 427/401 |
| 4,105,568 | 8/1978 | Marshall et al. | 252/8.9 |
| 4,108,781 | 8/1978 | Marshall et al. | 252/8.9 |
| 4,210,700 | 7/1980 | Marshall et al. | 156/110 A |

FOREIGN PATENT DOCUMENTS

| | | | |
|---|---|---|---|
| 2012481 | 3/1970 | France | 156/110 A |
| 1035220 | 7/1966 | United Kingdom | 156/110 A |

*Primary Examiner*—Ronald W. Griffin
*Attorney, Agent, or Firm*—Virginia S Andrews

[57] ABSTRACT

A fiber finish composition, a process which includes treating polyester yarn therewith and polyester yarn so treated are all disclosed. The fiber finish composition comprises a triglycidyl ether of glycerol; a low viscosity diglycidyl ether having the structural formula

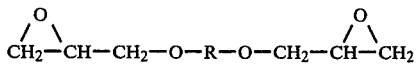

wherein R is alkylene or arylene; ethoxylated castor oil; an epoxy silane having the structural formula

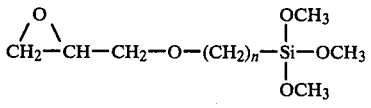

wherein n=2 to 5; and a solvent.

The process comprises the steps of (1) heating the yarn to a temperature of about 150° C. to 230° C. and (2) treating the yarn with the fiber finish composition, preferably utilized as an aqueous overfinish. The yarn is preferably used in tire cords for the construction of pneumatic passenger tires and results in excellent adhesion of tire cord to rubber.

28 Claims, No Drawings

PROCESS AND FINISH COMPOSITION FOR PRODUCING ADHESIVE ACTIVE POLYESTER YARN

BACKGROUND OF THE INVENTION

The present invention relates to a fiber finish composition, a process which includes treating polyester yarn therewith and polyester yarn so treated. More particularly, the present invention relates to a process for producing adhesive active polyester, preferably polyethylene terephthalate, yarn wherein the yarn is heated to a temperature of about 150° C. to 230° C. and treated with a fiber finish composition which comprises: a triglycidyl ether of glycerol; a low viscosity diglycidyl ether having the structural formula

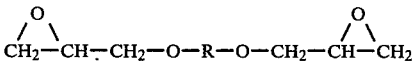

wherein R is alkylene or arylene; ethoxylated castor oil; an epoxy silane having the structural formula

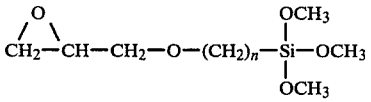

wherein n=2 to 5; and a solvent.

The yarn is subsequently twisted into tire cords for the construction of pneumatic passenger tires and results in excellent adhesion of tire cord to rubber.

DESCRIPTION OF THE PRIOR ART

Polyester tire cord requires the application of an adhesive layer to obtain bonding to the rubber. Two types of adhesive systems, a single dip and a double dip system, have been developed to meet this need.

In the double dip system, polyester cords are treated with a first dip which is a dispersion of a phenol-blocked methylene bisphenylene diisocyanate, an epoxy resin, wetting agents and water. The treated cord is cured, then treated with a second dip of resorcinol-formaldehyde-latex and cured again.

In the single dip system, an adhesive is incorporated in either a spin finish or an overfinish for application to the polyester yarn. The polyester yarn is plied and/or twisted into cords which are treated with a resorcinol-formaldehyde-latex dip and cured. The need for the blocked diisocyanate dip in cord processing is eliminated by this system. Low carboxyl polyester yarn treated with this system has very good ammonolytic and hydrolytic stability, but has poor adhesion to rubber when made into tire cord. Further, while regular carboxyl polyester yarn shows acceptable adhesion to rubber under normal curing temperatures, reduction of the curing temperatures for energy savings has been found to adversely affect adhesion to rubber.

The present invention significantly improves yarn to rubber adhesion of rubber to polyester tire cord treated with a single dip system for (a) low carboxyl polyester yarn wherein normal dip curing temperatures are utilized and (b) regular carboxyl polyester yarn wherein reduced dip curing temperatures are utilized.

The closest prior art is believed to be U.S. Pat. Nos. 3,672,977 to Dardoufas, 3,730,892 to Marshall et al., 3,793,425 to Arrowsmith and 4,044,189 to Arrowsmith.

SUMMARY OF THE INVENTION

The present invention provides a fiber finish composition, a process which includes treating polyester yarn therewith and polyester yarn so treated.

The fiber finish composition comprises: (1) about 50 to 79 weight percent of a solvent and (2) about 21 to 50 weight percent of an oil portion comprising: (a) about 6 to 36 weight percent of a triglycidyl ether of a glycerol; (b) about 6 to 22 weight percent of a low viscosity diglycidyl ether having the structural formula

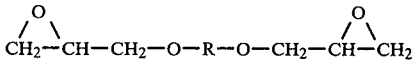

wherein R is alkylene or arylene; (c) about 28 to 82 weight percent of ethoxylated castor oil; and (d) about 6 to 22 weight percent of an epoxy silane having the structural formula

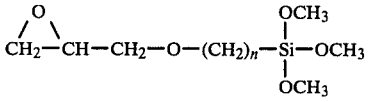

wherein n=2 to 5. The composition is applied to polyester yarn, preferably polyethylene terephthalate yarn, prepared by a process involving spinning and drawing steps as a spin finish and/or overfinish, most preferably as an overfinish. The preferred solvent is water, but any other solvent that is compatible with the triglycidyl ether of glycerol would be satisfactory, e.g., xylene, glycol ether, acetone, methylbutyl ketone, methylethyl ketone, methylbutyl ketone and toluene (50/50), and glycol ether and toluene (50/50).

A low viscosity diglycidyl ether is one which has a Brookfield viscosity at 25° C. of 10 to 500 centipoises. The preferred low viscosity diglycidyl ether is selected from the group consisting of 1,4-butanediol diglycidyl ether (viscosity, 15–20 cps, 25° C.), resorcinol diglycidyl ether (viscosity, 500 cps, 25° C.) and neopentyl glycol diglycidyl ether (viscosity, 10–16 cps, 25° C.), most preferably the former. The preferred epoxy silane is gamma-glycidoxypropyltrimethoxysilane. It is also preferred that the ethoxylated castor oil comprise about 50 weight percent ethoxylated castor oil containing about 6 moles of ethylene oxide per mole of castor oil and about 50 weight percent ethoxylated castor oil containing about 25 moles of ethylene oxide per mole of castor oil.

About 0.4 to 1.5 weight percent based on the weight of the yarn of the oil portion is added, or adds on, to the yarn, when utilized as an overfinish.

The present invention also provides a process for the production of polyester yarn, comprising the steps of: (a) heating the yarn to a temperature of about 150° to 230° C., more preferably about 190° to 220° C., and (b) treating the yarn with the fiber finish composition as described above. It is preferred that the heating step be carried out just prior to the treating step, by, for example, utilizing a slot applicator to apply the finish composition just after heating the yarn, e.g., via heated rolls. It is preferred that the yarn be treated with about 0.1 to 2.0 weight percent based on the weight of the yarn of the composition when used as a spin finish, and that about 0.05 to 0.4 weight percent based on the weight of the yarn, of spin finish oil, remain on the yarn after high temperature processing. When the composition is utilized as an overfinish, it is preferred that the yarn be treated with about 1 to 2 weight percent based on the weight of the yarn of the overfinish composition and that about 0.4 to 1.5, more preferably about 0.8 to 1.0, weight percent based on the weight of the yarn, of overfinish oil, remain on the yarn after high temperature processing. When the composition is utilized as both the spin finish and the overfinish, it is preferred that the yarn be treated with a total of about 1.1 to 4 weight percent based on the weight of the yarn of the composition and that about 0.45 to 1.75 weight percent based on the weight of the yarn of the oil portion remains on the yarn after high temperature processing.

The present invention also provides, in a process for the production of polyester yarn involving spinning and drawing steps, the improvement which comprises heating the yarn, subsequent to the drawing step, to a temperature of about 190° to 220° C.; and applying to the yarn an overfinish composition comprising about 50 to 79 weight percent of water and about 21 to 50 weight percent of an oil portion, the oil portion comprising: about 6 to 36 weight percent of a triglycidyl ether of glycerol, about 6 to 22 weight percent of a low viscosity diglycidyl ether having the structural formula

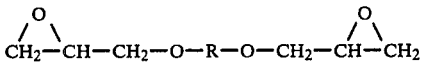

wherein R is alkylene or arylene, about 14 to 50 weight percent of ethoxylated castor oil containing about 6 moles of ethylene oxide per mole of castor oil, about 14 to 50 weight percent of ethoxylated castor oil containing about 25 moles of ethylene oxide per mole of castor oil, and about 6 to 22 weight percent of gamma-glycidoxypropyltrimethoxysilane; a sufficient amount of said overfinish composition being applied to achieve about 0.4 to 1.5 weight percent based on the weight of the yarn of overfinish oil on the yarn.

The present invention also includes polyester yarn having fiber finish compositions described above incorporated therewith, as well as polyester yarn produced in accordance with the above-defined processes.

Low carboxyl polyester yarn is defined as having about 8 to 18 carboxyl end groups (meq./kg.). Regular carboxyl polyester yarn is defined as having about 19 to 30 carboxyl end groups (meq./kg.). A low viscosity diglycidyl ether is a diglycidyl ether having a viscosity ranging from 10 to 300 centipoises.

The strip adhesion test utilized in illustrating the present invention is defined in U.S. Pat. No. 3,940,544 to Marshall et al., hereby incorporated by reference. The H-adhesion test utilized in illustrating the present invention is defined in the same patent.

DESCRIPTION OF THE PREFERRED EMBODIMENT

In order to demonstrate the invention, the following examples are given. They are provided for illustrative purposes only and are not to be construed as limiting the scope of the invention, which is defined by the claims. Specifically, it is believed that the finish composition can be applied either as a spin finish during spinning or as an overfinish subsequent to drawing of the yarn. Further, it is believed that there are other spin finishes which would perform with the finish of this invention as an overfinish as satisfactorily as the one detailed (see Table I). In these examples, parts and percentages are by weight unless specified otherwise.

The yarns utilized in this invention can be processed by any spin draw process or spinning and separately drawing process available to the art in the patent and technical literature, using any suitable polyester.

The preferred polyesters are the linear terephthalate polyesters, i.e., polyesters of a glycol containing from 2 to 20 carbon atoms and a dicarboxylic acid component containing at least about 75 percent terephthalic acid. The remainder, if any, of the dicarboxylic acid component may be any suitable dicarboxylic acid such as sebacic acid, adipic acid, isophthalic acid, sulfonyl-4,4'-dibenzoic acid, or 2,8-di-benzofuran-dicarboxylic acid. The glycol may contain more than two carbon atoms in the chain, e.g., diethylene glycol, butylene glycol, decamethylene glycol, and 1,4-bis(hydroxymethyl)cyclohexane. Examples of linear terephthalate polyesters which may be employed include poly(ethylene terephthalate), poly(butylene terephthalate), poly(ethylene terephthalate/5-chloroisophthalate) (85/15), poly(ethylene terephthalate/5-[sodium sulfo]isophthalate) (97/3), poly(cyclohexane-1,4-dimethylene terephthalate), and poly(cyclohexane-1,4-dimethylene terephthalate/hexahydroterephthalate) (75/25).

EXAMPLE 1 (CONTROL)

For comparative testing, a polyethylene terephthalate yarn having about 10 carboxyl end groups and as described in Example 2 of U.S. Pat. No. 4,171,422 to Lazarus et al., hereby incorporated by reference, was prepared in accordance with Example 1 of U.S. Pat. No. 4,113,821 to Russell et al., hereby incorporated by reference, with the following changes: Throughput rate was 80 pounds per hour, outlet pump pressure was 5,000 psi maximum, hot fluid (steam) temperature was about 500° C. and pressure was about 100 psig., the draw roll system was maintained at a temperature of about 130° C.–140° C., the relax roll system was maintained at a temperature of about 140° C., and the polyethylene terephthalate filaments were treated with about 0.45 percent based on the weight of the yarn of a liquid spin finish identified as Spin Finish B in Table I. (See U.S. Pat. No. 3,672,977 to Dardoufas, hereby incorporated by reference). Drawing performance of the yarn was excellent. Finish oil on fiber was about 0.15 to 0.25 percent.

To this yarn a secondary finish or overfinish, identified as Overfinish A of Table II, was applied by means of a conventional slot applicator located between the sets of draw and relax rolls (as depicted in FIG. 4 of U.S. Pat. No. 4,045,534 to Fisher et al., hereby incorporated by reference) at a 3 percent total wet pickup to achieve a total oil on yarn level of about 1.0 percent. The yarn was then twisted into three-ply cords having 9×9 twists per inch. Each cord was treated with a conventional non-ammoniated resorcinol-formaldehyde-latex dip comprising vinyl pyridine latex, resorcinol, formaldehyde, sodium hydroxide and water, at about 4.5 percent total solids pickup based on the weight of the cord. The cords were then cured at treating condition 3 of Table IV. Adhesion of these cords to rubber, a vital parameter in tire cord production, was measured according to the H-adhesion test. Results are recorded in Table V.

EXAMPLE 2 (COMPARATIVE)

The procedure of Example 1 was followed with the following changes: The draw rolls were maintained at a temperature of about 200° C. Results of the H-adhesion test are presented in Table V.

EXAMPLE 3

The procedure of Example 2 was followed with the substitution of Overfinish B of Table II for Overfinish A. H-adhesion test results are presented in Table V.

EXAMPLE 4 (CONTROL)

The procedure of Example 1 was followed with the substitution of Treating Condition 2 of Table IV for Treating Condition 3. H-adhesion test results are presented in Table V.

EXAMPLE 5 (COMPARATIVE)

The procedure of Example 4 was followed with the substitution of Heat Treatment 2 of Table III for Heat Treatment 1. H-adhesion test results are presented in Table V.

EXAMPLE 6

The procedure of Example 5 was followed with the substitution of Overfinish B of Table II for Overfinish A. H-adhesion test results are presented in Table V.

EXAMPLE 7 (COMPARATIVE)

The procedure of Example 1 was followed except that the draw rolls were maintained at a temperature of about 200° C., and Treating Condition 4 of Table IV was utilized in lieu of Treating Condition 3. Strip adhesion test results are presented in Table V.

EXAMPLE 8 (COMPARATIVE)

The procedure of Example 1 was followed with these changes: The draw rolls were maintained at a temperature of about 200° C., and a hot box containing circulating hot air and heating the yarn to a temperature of about 192° C. was utilized around the relax rolls which were maintained at a temperature of about 200° C.; see, for example, U.S. Pat. Nos. 2,807,863 to Schenker, 2,956,330 to Pitzl and Reissue 26,847 to Jaeggli. Overfinish A was applied at room temperature via a lube roll during a separate beaming operation approximately five (5) days after the yarn was spin-drawn. Results of the strip adhesion test are presented in Table V.

EXAMPLES 9–10

The procedure of Example 7 was followed in Example 9, and the procedure of Example 8 was followed in Example 10, each with the substitution of Overfinish B of Table II for Overfinish A. Strip adhesion test results are presented in Table V.

EXAMPLES 11–13

The procedure of Example 1 was followed in each of Examples 11–13 utilizing the overfinish, heat treatment and treating conditions detailed in Table V. Results of strip adhesion testing are presented in Table V. Example 11 was considered a control example.

EXAMPLES 14–21

The procedure of Example 1 was followed in each of Examples 14–21, utilizing the overfinish, heat treatment and treating conditions detailed in Table V. In Examples 14–17 treating conditions were not supplied by the customers making the adhesion evaluations; in Examples 18–21, only the RFL treating temperatures were supplied—it is believed that the other treating conditions would be similar to those listed in Table IV for the identical temperatures. The results of H-adhesion testing and strip adhesion testing, where available, are supplied in Table V.

EXAMPLE 22 (COMPARATIVE)

The procedure of Example 1 was followed utilizing the overfinish, heat treatment and treating conditions detailed in Table V. The results of strip adhesion testing are supplied in Table V.

EXAMPLE 23 (COMPARATIVE)

The procedure of Example 8 was followed utilizing the overfinish, heat treatment and treating conditions detailed in Table V. The results of strip adhesion testing are supplied in Table V.

EXAMPLES 24–26

For comparative testing, a polyethylene terephthalate yarn having about 24 carboxyl end groups and substantially as described in Example 4 of U.S. Pat. No. 4,171,422 to Lazarus et al. (14.0 percent ultimate elongation, tensile strength of 9.0 grams per denier, 60 percent retention of strength after exposure to pure ammonia gas for 3 hours at 150° C.), was prepared in accordance with Example 1 above. The overfinish, heat treatment and treating conditions utilized are detailed in Table V, as are the results of strip adhesion testing. Example 24 was deemed a control.

CONCLUSIONS

A comparison of Examples 1–3, 4–6 and 11–13 shows the critical importance to adhesion for low carboxyl polyethylene terephthalate yarn of both heating the yarn to a temperature of about 150° C. to 230° C. and treating the yarn with a finish composition as previously described. Examples 6–10 and 14–21 further demonstrate the criticality of using the finish composition described in conjunction with heating the yarn. Examples 22 and 23 also highlight the critical importance of the finish composition utilized.

A comparison of Examples 24–26 shows the critical importance to adhesion for regular carboxyl polyethylene terephthalate yarn of both heating the yarn to a temperature of about 150° C. to 230° C. and treating the yarn with a finish composition as previously described. Further, it can be seen that substantially lower curing temperatures (treating conditions of Table IV) can be utilized with the regular carboxyl yarn; this results in both energy savings and reduced plant emissions.

Note that the overfinish wet pickup can vary from about 0.9 to 3.5 weight percent based on the weight of the yarn.

TABLE I

SPIN FINISH COMPOSITION (PERCENT BY WEIGHT)

| | Finish Identities | | | | | |
|---|---|---|---|---|---|---|
| Components | A | B | C | D | E | F |
| EPON 812[1] | 3.6 | — | — | — | — | — |
| Gamma-glycidoxypropyl-trimethoxysilane | 3.6 | — | — | — | — | —10 |
| ARALDITE RD-2[2] | 3.6 | — | — | — | — | — |
| POE(6)* castor oil | 7.1 | — | — | — | — | — |
| POE(25)* castor oil | 7.1 | — | — | — | — | — |
| Isohexadecyl stearate | — | 15 | — | 30 | — | 13.5 |

TABLE I-continued

SPIN FINISH COMPOSITION (PERCENT BY WEIGHT)

| Components | Finish Identities A | B | C | D | E | F |
|---|---|---|---|---|---|---|
| Refined coconut oil | — | 15 | 30 | — | — | 13.5 |
| POE(4)* lauryl ether | — | 13 | 13 | 13 | 10 | 11.7 |
| Sodium salt of alkylaryl-sulfonate | — | 10 | 10 | 10 | 10 | 9.0 |
| POE(20)* tallow amine | — | 5 | 5 | 5 | 5 | 4.5 |
| Nekal WS-25[3] | — | 2 | 2 | 2 | — | 1.8 |
| Mineral oil | — | 40 | 40 | 40 | 40 | 36 |
| $C_8$–$C_{10}$ blended fatty acid ester of pentaerythritol | — | — | — | — | 30 | — |
| Aerosol OT-S[4] | — | — | — | — | 5 | — |
| Water | 75 | — | — | — | — | — |

*Moles of ethylene oxide per mole of base material.
[1]Shell Chemical Company's trade name for triglycidyl ether of glycerol [1,2,3-tris(2,3-epoxypropoxy)propane]. Component is also available under the trade name NER-010A from Nagase America.
[2]Ciba-Geigy's trade name for 1,4-butanediol diglycidyl ether, technical grade:

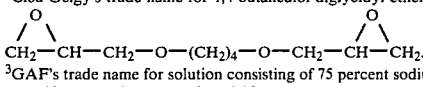

[3]GAF's trade name for solution consisting of 75 percent sodium dinonyl sulfosuccinate, 10 percent isopropanol, and 15 percent water.
[4]American Cyanamid's trade name for solution consisting of 70 percent sodium dioctyl sulfosuccinate and 30 percent petroleum distillate.

TABLE II

OVERFINISH COMPOSITIONS (PERCENT BY WEIGHT)

| Components | Finish Identities A | B | C | D |
|---|---|---|---|---|
| EPON 812[1] | — | 3.6 | — | — |
| Gamma-glycidoxypropyltrimethoxy-silane | 3.5 | 3.6 | 2.5 | 5 |
| Resorcinol diglycidyl ether | — | — | — | 10 |
| ARALDITE RD-2[2] | — | 3.6 | — | — |
| POE(6)* castor oil | — | 7.1 | 8.75 | — |
| POE(25)* castor oil | — | 7.1 | 8.75 | — |
| Butyl stearate | — | — | 5 | — |
| UCON 50 HB-100[3] | — | — | — | 56 |
| Giglycidyl ether of bisphenol A | — | — | 5 | |
| Isohexadecyl stearate | 18.8 | — | — | — |
| Glycerol monooleate | 1.7 | — | — | — |
| Decaglycerol tetraoleate | 1.4 | — | — | — |
| POE(15)* tall oil fatty acid | 2.3 | — | — | — |
| Sulfonated glycerol trioleate | 3.5 | — | — | — |
| POE(20)* tallow amine | 1.2 | — | — | — |
| Water | 67.6 | 75.0 | 70 | 29 |

*Moles of ethylene oxide per mole of base material.
[1]Shell Chemical Company's trade name for triglycidyl ether of glycerol [1,2,3-tris(2,3-epoxypropyl)propane]. Component is also available under the trade name NER-101A from Nagase America.
[2]Ciba-Geigy's trade name for 1,4-butanediol diglycidyl ether, technical grade;

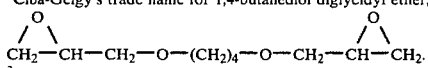

[3]Union Carbide Corporation's trade name for a water soluble polyalkylene glycol ether lubricant having a viscosity of 100 SUS at 100° F. (37.8° C.).

TABLE III

HEAT TREATMENT OF DRAWN YARN

| Condition | Draw Roll Temperatures (°C.) | (°F.) | Exposure (seconds) |
|---|---|---|---|
| 1 (control) | 130–140 | 266–284 | 0.15* |
| 2 | 190–200 | 374–392 | 0.25* |
| 3 | 230 | 446 | 0.25* |

*approximate value

TABLE IV

SINGLE DIP* TREATING CONDITIONS

| Condition | Drying - Oven Temperature (°C.) | (°F.) | Exposure (seconds) | Curing - Oven Temperature (°C.) | (°F.) | Exposure (seconds) |
|---|---|---|---|---|---|---|
| 1 | 149 | 300 | 80 | 224 | 435 | 60 |

TABLE IV-continued

SINGLE DIP* TREATING CONDITIONS

| Condition | Drying - Oven Temperature (°C.) | (°F.) | Exposure (seconds) | Curing - Oven Temperature (°C.) | (°F.) | Exposure (seconds) |
|---|---|---|---|---|---|---|
| 2 | 149 | 300 | 80 | 227 | 440 | 60 |
| 3 | 149 | 300 | 80 | 238 | 460 | 60 |
| 4 | 149 | 300 | 80 | 241 | 465 | 60 |

*Non-ammoniated RFL dip at 4.0 to 5.0 percent total solids pickup based on the weight of the cord, and 1 percent stretch.

TABLE V

| Example | COOH End Groups | Spin Finish[1] | Over-finish[2] | Heat Treat-ment[3] |
|---|---|---|---|---|
| 1 | 10 | B | A | 1 |
| 2 | 10 | B | A | 2 |
| 3 | 10 | B | B | 2 |
| 4 | 10 | B | A | 1 |
| 5 | 10 | B | A | 2 |
| 6 | 10 | B | B | 2 |
| 7 | 10 | B | A | 2 |
| 8 | 10 | B | A | 2 |
| 9 | 10 | B | B | 2 |
| 10 | 10 | B | B | 2 |
| 11 | 10 | B | A | 1 |
| 12 | 10 | B | A | 2 |
| 13 | 10 | B | B | 2 |
| 14* | 10 | B | A | 2 |
| 15* | 10 | B | B | 2 |
| 16* | 10 | B | A | 2 |
| 17* | 10 | B | B | 2 |
| 18* | 10 | B | A | 2 |
| 19* | 10 | B | B | 2 |
| 20* | 10 | B | A | 2 |
| 21* | 10 | B | B | 2 |
| 22 | 10 | B | C | 2 |
| 23 | 10 | B | D | 2 |
| 24 | 24 | B | A | 1 |
| 25 | 24 | B | A | 3 |
| 26 | 24 | B | B | 3 |

| Example | Treating Con-ditions[4] | Adhesion H-Adhesion (pounds) | Strip Adhesion[5] (pounds pull) | (visual rating) |
|---|---|---|---|---|
| 1 | 3 | 27 | — | — |
| 2 | 3 | 29 | — | — |
| 3 | 3 | 32 | — | — |
| 4 | 2 | 23 | — | — |
| 5 | 2 | 22 | — | — |
| 6 | 2 | 27 | — | — |
| 7 | 4 | — | 26 | 3.0 |
| 8 | 4 | — | 26 | 4.0 |
| 9 | 4 | — | 27 | 4.5 |
| 10 | 4 | — | 22 | 4.5 |
| 11 | 4 | — | 24 | 2.5 |
| 12 | 4 | — | 26 | 3.0 |
| 13 | 4 | — | 27 | 4.5 |
| 14* | — | 16.5 | — | — |
| 15* | — | 20.0 | — | — |
| 16* | — | 26 | 42 | 7.0[6] |
| 17* | — | 30 | 38 | 7.0[6] |
| 18* | 238° C. | 27 | 70 | 4.0[6] |
| 19* | 238° C. | 32 | 73 | 4.0[6] |
| 20* | 227° C. | 23 | 30 | 1.0[6] |
| 21* | 227° C. | 27 | 50 | 2.0[6] |
| 22 | 4 | — | 20 | 2.5 |
| 23 | 4 | — | 18 | 2.5 |
| 24 | 1 | — | 22 | 3.0 |
| 25 | 1 | — | 23 | 3.0 |

TABLE V-continued

| | | | | |
|---|---|---|---|---|
| 26 | 1 | — | 25 | 4.5 |

Footnotes to Table V
[1]See Table I.
[2]See Table II.
[3]See Table III.[4]See Table IV. Note that where a temperature is given rather than a condition number, the temperature is the only information supplied by the customer making the evaluation; it is believed that the treating conditions would be similar to those listed in Table IV for the identical temperatures.
[5]Tested at 250° F. (121° C.)
[6]Evaluated in a scale ranging from 1 to 10 rather than from 1 to 5. Adhesion tests were made at room temperature (about 25° C.).
*Examples 14 through 21 were evaluated for adhesion by customers. For the sake of comparison, Examples 14 and 15 were evaluated by one customer, Examples 16 and 17 by another and Examples 18 through 21 by yet a third customer. All other evaluations were made internally.

What is claimed is:

1. A fiber finish composition, comprising:

(a) about 50 to 79 weight percent of a solvent, and (b) about 21 to 50 weight percent of an oil portion, comprising:

(1) about 6 to 36 weight percent of a triglycidyl ether of glycerol;

(2) about 6 to 22 weight percent of a diglycidyl ether having a Brookfield viscosity at 25° C. of 10 to 500 centipoises and having the structural formula

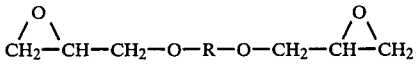

wherein R is alkylene or arylene;

(3) about 28 to 82 weight percent of ethoxylated castor oil; and (4) about 6 to 22 weight percent of an epoxy silane having the structural formula

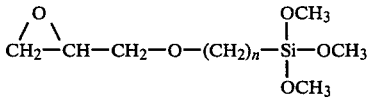

wherein n=2 to 5.

2. The fiber finish composition of claim 1 wherein the solvent is water.

3. The fiber finish composition of claim 2 wherein the diglycidyl ether is selected from the group consisting of 1,4-butanediol diglycidyl ether, resorcinol diglycidyl ether and neopentyl glycol diglycidyl ether.

4. The fiber finish composition of claim 3 wherein the diglycidyl ether is 1,4-butanediol diglycidyl ether.

5. A polyester yarn having the fiber finish composition of claim 4 incorporated therewith.

6. A polyester yarn having the fiber finish composition of claim 2 incorporated therewith.

7. The yarn of claim 6 wherein from about 0.4 to 1.5 weight percent based on the weight of the yarn of the oil portion is present.

8. The fiber finish composition of claim 2 wherein the epoxy silane is gamma-glycidoxypropyltrimethoxysilane.

9. A polyester yarn having the fiber finish composition of claim 8 incorporated therewith.

10. The fiber finish composition of claim 2 wherein the ethoxylated castor oil comprises about 50 weight percent ethoxylated castor oil containing about 6 moles of ethylene oxide per mole of castor oil and about 50 weight percent ethoxylated castor oil containing about 25 moles of ethylene oxide per mole of castor oil.

11. A polyester yarn having the fiber finish composition of claim 10 incorporated therewith.

12. The fiber finish composition of claim 2 wherein the diglycidyl ether is 1,4-butanediol diglycidyl ether, the ethoxylated castor oil comprises about 50 weight percent ethoxylated castor oil containing about 6 moles of ethylene oxide per mole of castor oil and about 50 weight percent ethoxylated castor oil containing about 25 moles of ethylene oxide per mole of castor oil, and the epoxy silane is gamma-glycidoxypropyltrimethoxysilane.

13. A polyester yarn having the fiber finish composition of claim 12 incorporated therewith.

14. A process for the production of polyester yarn comprising the steps of:

(a) heating the yarn to a temperature of about 150° C. to 230° C.; and (b) treating the yarn with a fiber finish composition comprising: (1) about 21 to 50 weight percent of an oil portion comprising: about 6 to 36 weight percent of a triglycidyl ether of glycerol; about 6 to 22 weight percent of a diglycidyl ether having a Brookfield viscosity at 25° C. of 10 to 500 centipoises and having the structural formula

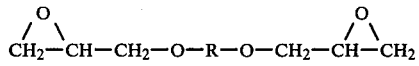

wherein R is alkylene or arylene; about 28 to 82 weight percent of ethoxylated castor oil; and about 6 to 22 weight percent of an epoxy silane having the structural formula:

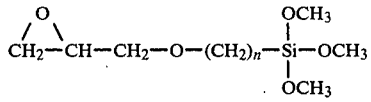

wherein n=2 to 5; and (2) about 50 to 79 weight percent of a solvent.

15. The process of claim 14 wherein the heating step follows the treating step.

16. The process of claim 14 wherein the treating step follows the heating step.

17. The process of claim 14 wherein the solvent is water.

18. The process of claim 17 wherein the yarn is first drawn and then the fiber finish composition is applied as an overfinish.

19. The process of claim 18 wherein a sufficient amount of said overfinish composition is applied to the yarn to provide about 0.4 to 1.5 weight percent based on the weight of the yarn of the oil portion on the yarn.

20. The process of claim 14 wherein the diglycidyl ether is selected from the group consisting of 1,4-butanediol diglycidyl ether, resorcinol diglycidyl ether and neopentyl glycol diglycidyl ether.

21. The process of claim 20 wherein the diglycidyl ether is 1,4-butanediol diglycidyl ether.

22. The process of claim 14 wherein the epoxy silane is gamma-glycidoxypropyltrimethoxysilane.

23. The process of claim 14 wherein the ethoxylated castor oil comprises about 50 weight percent ethoxylated castor oil containing about 6 moles of ethylene oxide per mole of castor oil and about 50 weight percent ethoxylated castor oil containing about 25 moles of ethylene oxide per mole of castor oil.

24. The process of claim 14 wherein the diglycidyl ether is 1,4-butanediol diglycidyl ether, the ethoxylated castor oil comprises about 50 weight percent ethoxylated castor oil containing about 6 moles of ethylene oxide per mole of castor oil and about 50 weight percent of ethoxylated castor oil containing about 25 moles of ethylene oxide per mole of castor oil, and the epoxy silane is gamma-glycidoxypropyltrimethoxysilane.

25. In a process for the production of polyester yarn involving spinning and drawing steps, the improvement which comprises (a) heating the yarn, subsequent to the drawing step, to a temperature of about 190° C. to 220° C.; and (b) applying to the yarn an overfinish composition comprising about 50 to 79 weight percent of water and about 21 to 50 weight percent of an oil portion, the oil portion comprising: about 6 to 36 weight percent of a triglycidyl ether of glycerol, about 6 to 22 weight percent of 1,4-butanediol diglycidyl ether, about 14 to 50 weight percent of ethoxylated castor oil containing about 6 moles of ethylene oxide per mole of castor oil, about 14 to 50 weight percent of ethoxylated castor oil containing about 25 moles of ethylene oxide per mole of castor oil, and about 6 to 22 weight percent of gamma-glycidoxypropyltrimethoxysilane, a sufficient amount of said overfinish composition being applied to the yarn to provide about 0.4 to 1.5 weight percent based on the weight of the yarn of the overfinish oil on the yarn.

26. The process of claim 25 wherein the step of heating the yarn follows the step of applying to the yarn the overfinish composition.

27. The process of claim 25 wherein the step of heating the yarn precedes applying the overfinish composition to the yarn.

28. A polyester yarn produced in accordance with the process of claim 25.

* * * * *